US005788559A

United States Patent [19]

Jungnitsch

[11] Patent Number: 5,788,559

[45] Date of Patent: Aug. 4, 1998

[54] WEB ADJUST DRILL BIT SHARPENER AND METHOD OF USING

[76] Inventor: Paul Lewis Jungnitsch, 10195 Empress Ave., San Diego, Calif. 92126-3503

[21] Appl. No.: 621,321

[22] Filed: Mar. 25, 1996

Related U.S. Application Data

[63] Continuation-in-part of Ser. No. 202,036, Feb. 25, 1994, abandoned.

[51] Int. Cl.[6] ..... B24B 1/00; B24B 19/16

[52] U.S. Cl. ..... 451/48; 451/375; 451/376; 269/902

[58] Field of Search ..... 451/48, 364, 365, 451/367, 374, 375, 376; 269/86, 87, 257, 902

[56] References Cited

U.S. PATENT DOCUMENTS

| | | | |
|---|---|---|---|
| 2,472,040 | 5/1949 | Brookfield | 279/6 |
| 2,660,008 | 11/1953 | Reading . | |
| 2,780,894 | 2/1957 | Jensch . | |
| 2,848,847 | 8/1958 | Casselman . | |
| 3,022,609 | 2/1962 | Abadjieff . | |
| 3,753,320 | 8/1973 | Wurscher | 451/375 |
| 3,851,424 | 12/1974 | Kawaragi | 41/375 |
| 3,852,921 | 12/1974 | Craig et al. | 451/375 |
| 3,916,570 | 11/1975 | Caley | 451/375 |
| 4,340,211 | 7/1982 | Chiappetti | 269/110 |
| 4,483,104 | 11/1984 | Welliver | 451/375 |
| 4,485,596 | 12/1984 | Bernard et al. | 451/375 |
| 4,646,474 | 3/1987 | Chen . | |
| 4,703,588 | 11/1987 | Hosoi | 451/375 |
| 4,854,568 | 8/1989 | Baeza et al. | 269/268 |
| 4,858,389 | 8/1989 | Wurscher | 451/375 |
| 4,916,867 | 4/1990 | Lockwood | 451/375 |
| 4,995,301 | 2/1991 | Phillips, Sr. | 451/375 |
| 5,210,977 | 5/1993 | Werner | 451/375 |
| 5,358,228 | 10/1994 | Beere | 269/244 |
| 5,452,885 | 9/1995 | Beere | 269/32 |

OTHER PUBLICATIONS

Machinery's Handbook, 22nd Edition; Erik Oberg, Franklin D. Jones and Holbrook L. Horton; Jul. 1985; pp. 1835–1837.

*Primary Examiner*—Timothy V. Eley

[57] ABSTRACT

A process and apparatus for sharpening twist drill bits, for use with a rotary abrasive wheel. The apparatus has a vertical support plate connectable to a standard adjustable base. A cylindrical ring rotatably mounted in the support plate has a radial dovetailed groove on its front face. A sliding plate, with a mounting flange and hole for a chuck on its angled front face, slides in the dovetailed groove of the ring. An angled bar is mounted on the rear face of the ring, to act as an alignment pointer. Both the ring and the sliding plate each have an angled notch cut out of its front face. The two notches are adjacent to each other, and their two opposite edges are aligned when the sliding plate is centered in the ring. In use, the end of a drill bit is placed into the notches, so that the web of the drill bit can be used as a measurement to offset the position of the sliding plate from center. The drill bit is then installed in a chuck on the mounting flange, with the tip of the drip bit extending through the holes in the sliding plate and ring. The pointer is used to position the drill bit radially and axially. The ring and chuck are then caused to rotate, to grind an offset tilted cone shape on the end of the drill bit. A further development has the rotating member horizontally slidable, while restricting movement of the angle plate, to form a straight chisel edge on the drill bit.

8 Claims, 7 Drawing Sheets

WEB ADJUST DRILL BIT SHARPENER AND METHOD OF USING

This application is a continuation-in-part of application Ser. No. 08/202,036, filed Feb. 25, 1994, now abandoned.

BACKGROUND OF THE INVENTION

1. Technical Field

This invention relates to the sharpening of twist drill bits.

2. Background Art

Dimensional analysis of twist drill bits in common usage reveals the following:

Each end face, or land, is shaped in the form of a conical section, which has the following properties:

The apex angle of the conical section is the same as the point angle of the drill bit.

The axis of the conical section is tilted from the drill bit axis, by the same amount and in the same direction as the lip relief angle.

The axis of the conical section is radially offset from the drill bit axis to provide a chisel edge on the web; the offset being proportional to the web thickness.

The cutting lip is on a radius of the conical section.

The cone-shape may be warped to provide a straight chisel edge.

Portions of the conical section may be removed to provide for other features, such as web thinning or split point sharpening.

The conical section's position and dimensions are not affected by the drill bit diameter. Mechanisms and methods are known to exist which attempt to produce this shape on a drill bit:

Machinery's Handbook shows a method wherein a drill bit is rotated about an inclined axis angled from the grinding surface by an amount approximately one-eighth of the point angle of the drill bit. The drill bit axis is inclined from the grinding surface in the same direction as the axis of rotation, and offset horizontally from the axis of rotation to provide a lip relief. This method produces a cone shaped surface which has an apex angle approximately one-fourth of the point angle of the drill bit.

U.S. Pat. No. 2,660,008 discloses an apparatus which rotates a drill bit about a horizontal axis which is angled from the drill bit axis, and which intersects the drill bit at a point behind the cutting edges along the flutes. It is not specified if the axis of rotation intersects the grinding wheel axis. The shank of a drill bit is used as a measurement to offset the axis of rotation from the grinding wheel surface, in a direction parallel to a vertical plane containing the drill bit axis. This apparatus produces a cone-shaped surface on a drill bit. The apex angle of the cone-shape is shown by the specified dimensions to be approximately 68 degrees smaller than the point angle of the drill bit.

U.S. Pat. No. 2,780,894 discloses an apparatus which rotates a drill bit about an axis at a compound angle to the grinding wheel surface. The axis of rotation intersects the drill bit at an angle to the drill bit axis and behind the cutting edges. The axis of rotation does not intersect the grinding wheel axis. This apparatus produces a concave conical shape. The apex angle of the cone shape is significantly smaller than the point angle of the drill bit.

U.S. Pat. No. 2,848,847 discloses an apparatus which rotates a drill bit about its own horizontal axis, while simultaneously pivoting about a vertical axis which intersects the drill bit axis behind the cutting edges. The inventor preferably has the axis of rotation above the horizontal axis of the grinding wheel to provide a lip relief. This apparatus produces a concave helical bevel, which has a continuously changing bevel angle.

U.S. Pat. No. 3,022,609 discloses an apparatus which positions a drill bit in an angular and radial alignment with the flat face of a grinding wheel. This apparatus produces flat planar surfaces on a drill bit.

U.S. Pat. Nos. 3,753,320 and 4,858,389 each disclose an apparatus in which the concave inside surface of a cone-shaped grinding wheel is used to produce a cone shape. A drill bit is rotated by hand about its own axis, and moved axialy during rotation by using the other face of the drill bit as a cam surface. These devices produce a true cone shape at the start and end of each grinding motion, with a helical bevel shape joining the two cone surfaces. The drill bit axis is offset a relatively long distance from the cone axis of these devices, such that the cone-shaped portions are relatively flat. The helical bevel portion provides a lip relief, but the cone-shaped portions do not.

U.S. Pat. No. 3,851,424 discloses an apparatus which rotates a drill bit about its own axis, while its axis is revolved in a cylindrical plane by a set of gears. The drill bit is also simultaneously moved axialy by a cam. The drill bit axis is parallel with, and remains equidistant to the axis of the cylindrical motion. This apparatus produces a helical bevel which follows the shape of the cam.

U.S. Pat. No. 3,852,921 discloses an apparatus in which drill bit is rotated about an axis parallel to the drill bit axis. This produces a true cone shape, but with no lip relief for the drill bit. Expert hand turning of the axial feed knob during sharpening could produce a lip relief, but would alter the cone shape to that of a helical bevel.

U.S. Pat. No. 3,916,570 discloses an apparatus which rotates drill bit on its own axis, while a cam simultaneously moves the drill bit in a line which forms a radius to the flat face of a grinding wheel. An adjoining surface of the grinding wheel is cone shaped. This apparatus produces a helical bevel which follows the cam shape.

U.S. Pat. No. 4,483,104 discloses an apparatus which rotates a drill bit about its own axis, while using a cam to move the drill bit axialy. The rotational axis does not intersect the grinding wheel axis. The resulting shape is a concave helical bevel which follows the shape of the cam.

U.S. Pat. No. 4,485,596 discloses an apparatus which holds a drill bit in an axial and radial alignment while feeding into a grinding wheel. This produces a concave cylindrical cutout portion for point-splitting or web thinning.

U.S. Pat. No. 4,646,474 discloses an apparatus which rotates a drill bit about a horizontal axis angled 45 degrees from the horizontal drill bit axis. The drill bit axis is offset vertically from the rotational axis to provide a lip relief. This apparatus produces a cone shaped surface which adjoins a cylindrical surface at the cutting lip, with the apex angle of the cone-shape being approximately 90 degrees smaller than the point angle of the drill bit.

U.S. Pat. No. 4,703,588 discloses an apparatus which rotates a drill bit about its own axis, while using an adjustable cam to move the drill bit linearly at an angle to the grinding wheel surface, to provide a lip relief. This apparatus produces a helical bevel which follows the shape of the cam.

U.S Pat. No. 4,916,867 discloses an apparatus which rotates a drill bit around an axis angled from the drill bit axis. The axis of rotation is parallel to the grinding wheel axis, and is offset fron the drill bit axis to provide a lip relief This apparatus produces a cylindrical shape.

U.S. Pat. No. 4,995,301 discloses an apparatus which rotates a drill bit around an axis offset from, and parallel to the drill bit axis. An adjustable cam causes axial movement during rotation. This apparatus produces a helical bevel which follows the shape of the cam.

U.S. Pat. No. 5,210,977 discloses an apparatus in which a drill bit is rotated by hand about its own axis, while being hand pressed against a convex cone-shaped grinding wheel. The drill bit axis is parallel to the grinding wheel axis. The angle of the grinding wheel surface controls the angle of the bevel ground on the drill bit. No other aspects of the drill bit shape are controlled. With expert hand control the mechanism can grind a helical bevel, but tends to gouge a concave cone shape.

None of the prior art rotates a drill bit about an axis which is properly located to produce the ideal shape. None of the prior art produces a conical shape which is tilted from the drill bit axis by an amount based on the drill bit lip relief angle. None of the prior art produces a conical shape which is radially offset from the drill bit axis by an amount based on the drill bit web thickness.

SUMMARY OF THE INVENTION

The present invention rotates a drill bit about a horizontal axis which is angled from the grinding surface by an amount equal to one-half of the point angle of the drill bit. The drill bit's longitudinal axis is angled from the sharpening assembly's axis of rotation by the same amount as, and in the same direction as, the lip relief angle of the drill bit. The bit's longitudinal axis is offset radially from the assembly's axis of rotation, by a distance which is proportional to the web thickness of the drill bit. The radial offset is the only adjustment needed for differently sized drill bits. The assembly's axis of rotation intersects the grinding wheel rotational axis, and intersects a line which is co-linear with a cutting lip of the drill bit. The resulting shape produced is that of a tilted offset right circular conical section having an apex angle the same as the point angle of the drill bit.

A tray type chucking mechanism is provided, which holds a drill bit in a concentric alignment. The chuck is removable for drill bit cooling and inspection, and is held on the alignment pins of the sharpener by hand to allow for hand feed pressure while grinding. The clamping members of the chuck support a drill bit on at least two lands at each of three positions around the circumference of the drill bit.

An object of the present invention is to provide an apparatus which sharpens twist drill bits by reproducing a shape identical to the shape generally provided on new drill bits.

A second object of the invention is to provide an apparatus for sharpening drill bits, in which all aspects of a drill bit shape, important to drilling holes including point angle, lip relief angle and chisel edge angle, are controllable and independent of each other, and not affected by adjustments for drill bit size.

A third object of the invention is to provide an apparatus which is easy to adjust and use, and which is of the simplest possible construction.

These and other objects and features will become evident by reading the detailed descriptions.

DESCRIPTION OF THE PREFERRED EMBODIMENTS

Figure 1A:
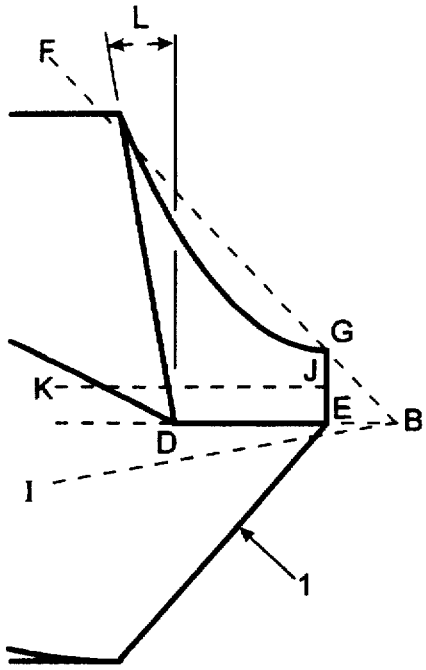
FIG. 1*a*, 1*b* and 1*c* are three views of an ideal twist drill bit.
Figure 1B:
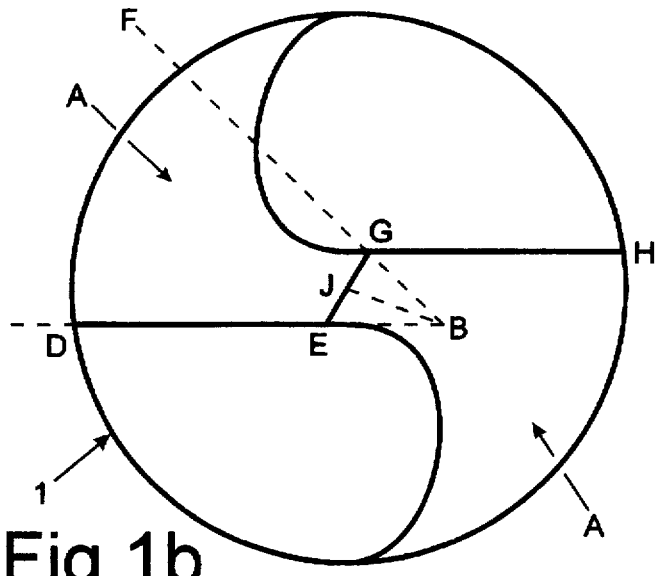
Figure 1C:
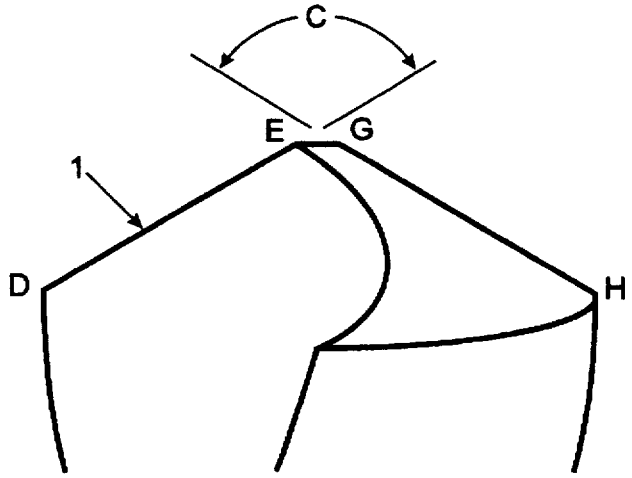
Figure 2:
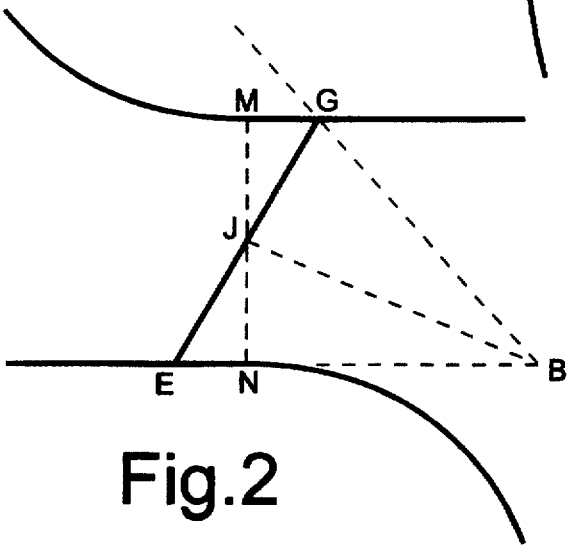
FIG. 2 is an enlarged detail of the center portion of the drill bit shown in FIG. 1*b*.
Figure 3:
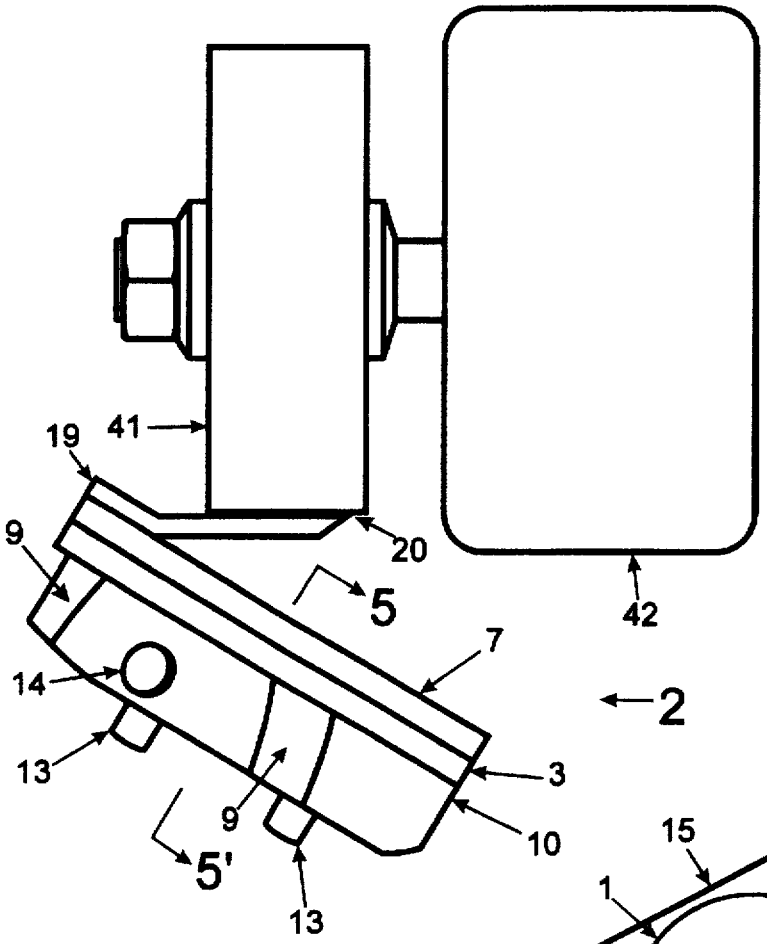
FIG. 3 is a plan view of a preferred embodiment of the invention, positioned for use with a rotary abrasive wheel.

In FIG. 1*a*, 1*b*, 1*c*, a drill bit1 is sharpened by removing material from the identical end facesA. Each end faceA is shaped to form a conical section, which has an apexB and a radiusBD co-linear with a cutting lipDE. A second radiusBF passes through a pointG at the intersection of the chisel edgeEG and the other cutting lipGH. The axisBI of the conical section is angled from the drill bit longitudinal axisJK at the same angle and in the same direction as lip relief angleL. The direction of radial offsetBJ is dependent on the lip relief angleL, the point angleC, and the chisel edge angle (angle DEG as shown in FIG. 1*b*) of drill bit1. The length of radial offsetBJ, shown enlarged in FIG. 2, is directly dependent on the web thicknessMN divided by twice the sine of the offset angleNBJ. Thus the length of radial offsetBJ is directly proportional to the web thicknessMN.

Figure 5:
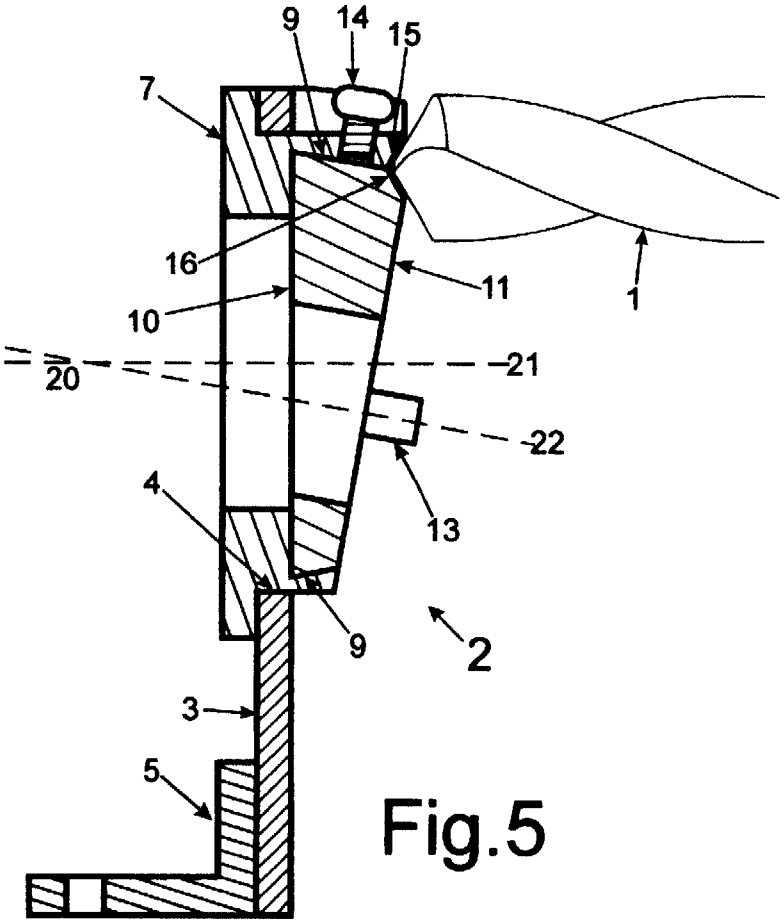
FIG. 5 is a sectional view of a preferred embodiment of the invention, looking in the direction of arrows 5—5' in FIG. 3, with the addition of a mounting bracket and a drill bit, and with a knob shown out of position.
Figure 4:
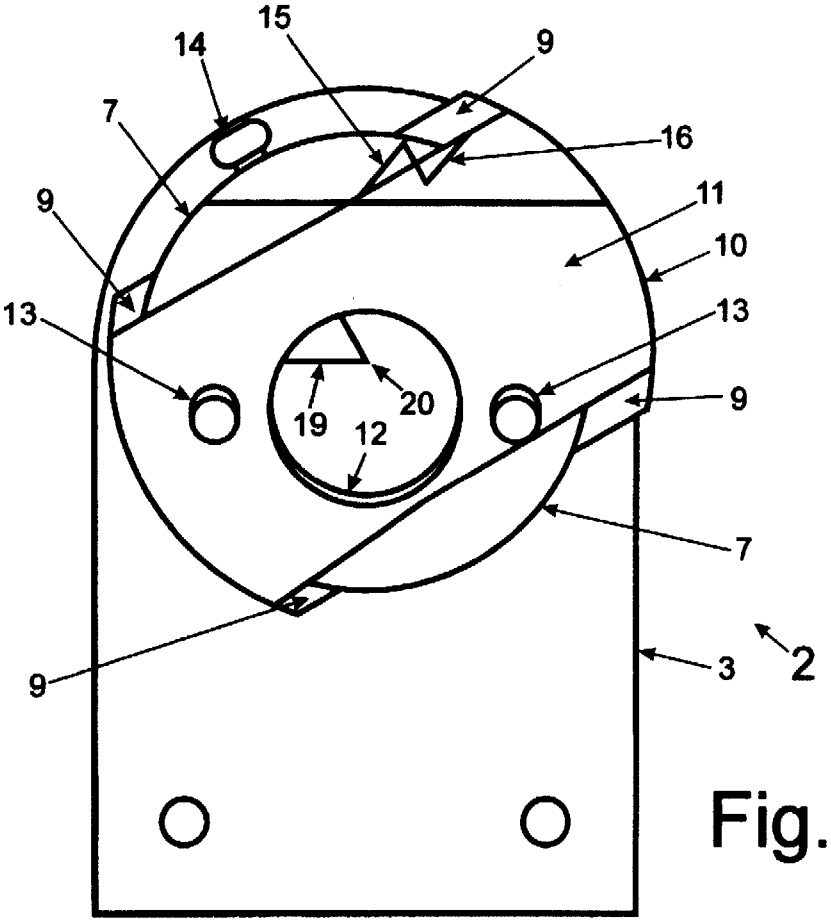
FIG. 4 is a front elevational view of a preferred embodiment of the invention.

On orbit assembly2, shown in FIG. 3, 4, 5, 5*a*, and 5*b*, a generally vertical support member (designated as support plate3), with a bearing means (designated as hole4), is attached to a bracket5 (shown only in FIG. 5). Bracket5 is provided to hold support plate3 generally perpendicular on a suitable work surface. A rotatable member (designated as ring7) is installed in support plate3, with its cylindrical outer surface residing rotatably in hole4. A slidable member (designated as front plate10), with two beveled edges9, is slidably seated in a beveled radial groove on the front of ring7. Front plate10 is longer that the diameter of ring7. Both ends of front plate10 protrude beyond the radial beveled groove of ring7, and rest against the front face of support plate3. Front plate10 also has an angled seating surface (designated as fange11) and hole12 for installing a drill bit holding assembly (described later). Pins13 provide for locating the drill bit holding assembly on flange11.

Figure 7:
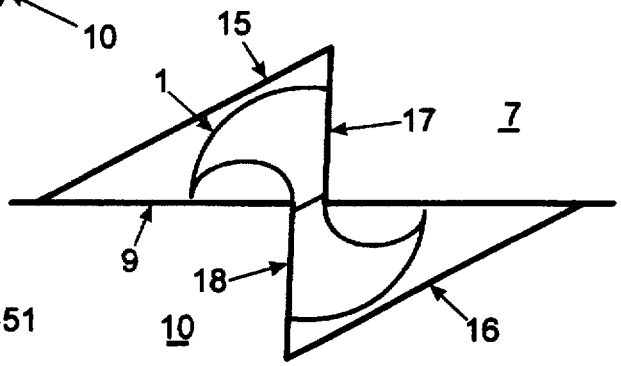
FIG. 7 is a diagram showing the web offset process.

Lockscrew14, screwed into ring7, is hand tightened against a beveled edge9 of front plate10, to maintain the position of front plate10 in relation to ring7. Notch15 on ring7 and notch16 on front plate10 have adjacent alignment edges17 and 18 (shown enlarged in FIG. 7). Pointer19, attached to the rear face of ring7, has its end point20 along the rotational axis21 of ring7. The axis22 of hole 12 is angled vertically from the rotational axis21 of ring7 the same amount as lip relief angleL. The axis22 intersects rotational axis21 at the ]same end point20, when front plate10 is positioned centrally in ring7.

Figure 6B:
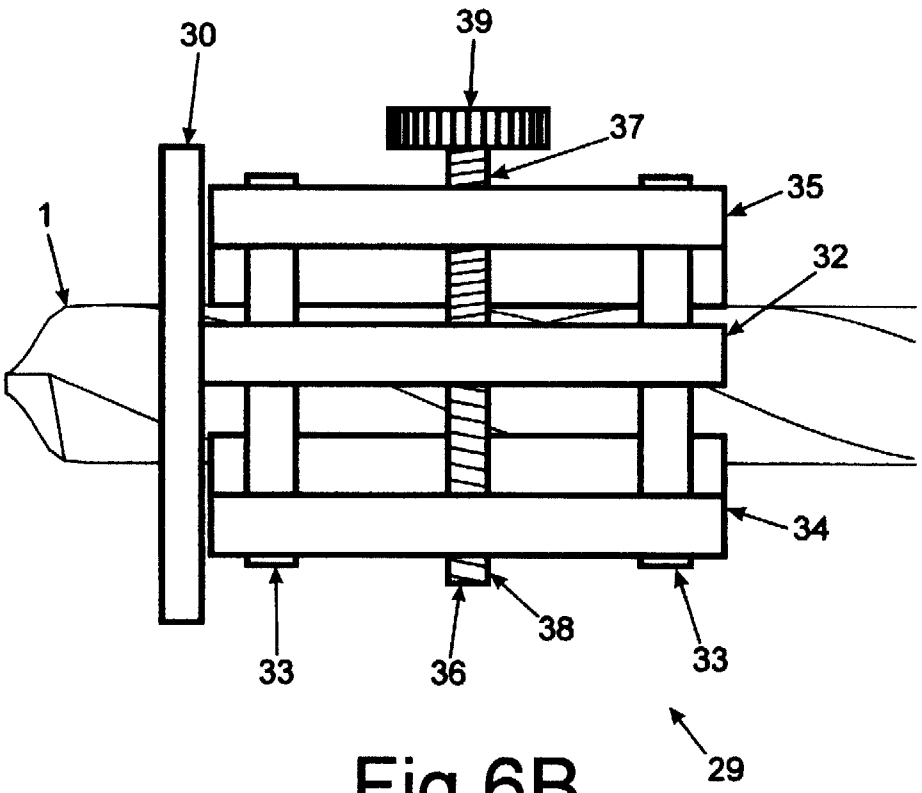
FIG. 6*a* and 6*b* are end and side elevational views, respectively, of a new chuck.
Figure 6A:
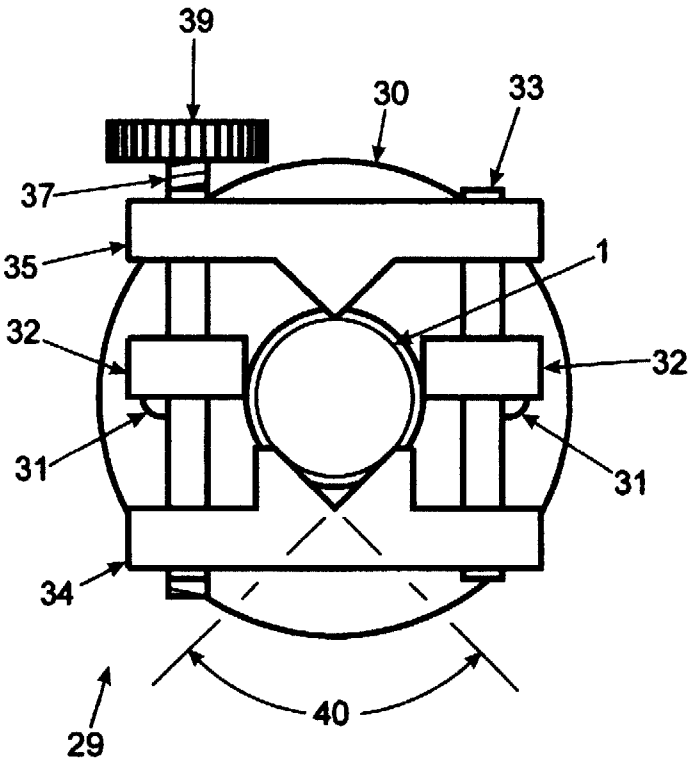

FIG. 6*a* and 6*b* show a drill bit holding assembly (designated as chuck29). Chuck29 has a support frame comprised of chuck plate30 and bars32. Chuck plate30 has two holes31 aligned 180 degrees apart radially from the center of chuck plate30. Holes31 allow chuck plate30 to be installed on pins13 of flange11 in each of two positions, with the center of chuck plate30 aligned with hole12. Rods33, parallel to each other and to chuck plate30, are inserted through bars32, and act as guides for two gripping members (designated as tray34 and wedge35). An externally threaded rod (designated as leadscrew36) rotates in one bar32 but is prevented from moving axially. Threaded portion37 has a right-hand relatively fine pitch thread through a threaded hole in wedge35, while threaded portion38 has threads which are left-hand with a relatively course pitch through a threaded hole in tray34. When leadscrew36 is turned using knob39, the tray34 and wedge35 will be moved inwardly or outwardly together on rods33 at different rates. Bars32 are positioned on chuck plate30, such that the root of tray34 and the crown of wedge35 will meet along the axis of chuck plate30.

Tray angle40 is constructed such that:

TRAY ANGLE40=2 ARCSINE (THREAD PITCH ON THREADED PORTION37/THREAD PITCH ON THREADED PORTION37)

Thus any cylindrical object clamped in tray34 with wedge35 will be in the same coaxial alignment with chuck plate30. When drill bit1 is installed in chuck29, and chuck29 installed on pins13, the drill bit longitudinal axisJK is co-linear with the axis22 through the center of hole12, as shown if FIG. 5*a*.

In use, the orbit assembly2 is installed with pointer19 adjacent to an abrasive wheel41. If the orbit assembly2 is installed with pointer19 adjacent to a curved radial surface of abrasive wheel41, as in FIG. 3 and 5*a*, then the rotational axis21 must intersect with the abrasive wheel41 rotational axis, so that the curvature of the wheel does not affect the drill bit shape. The bottom edge of pointer19 is angled from rotational axis21 by an amount equal to one-half of the point angleC of drill bit1.

The assembly2 may then be adjusted for drill bit size, before sharpening each drill bit. Notches15 and 16 provide a gauging means for positioning front plate10 in ring7. The web of drill bit1 may be used as a spacer for adjustment, by inserting the cutting end of drill bit1 into notches15 and 16, as in FIG. 5. The drill bit1 and front plate10 are positioned such that the two cutting lipsDE and GH are held against alignment edges17 and 18, as in FIG. 7. Lockscrew14 is then tightened. A constant of proportionality, between the web thicknessMN of drill bit1 and the radial offsetBJ, is provided for by the angle between a beveled edge9 and alignment edges17 and 18. The front plate10 and axis22 are thus radially offset from the rotational axis21 of ring7 (the same as cone axisBI), by an amount proportional to the drill bit web thicknessMN.

Figure 5A:
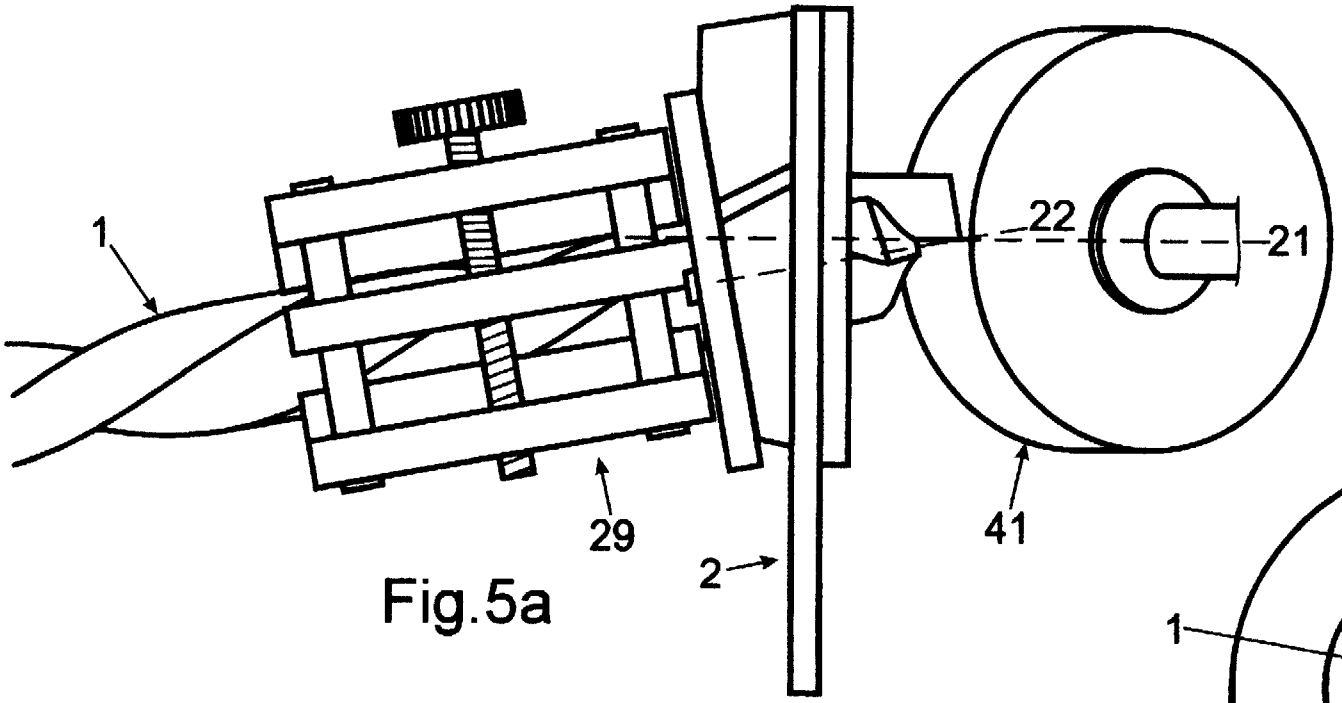
FIG. 5*a* is a side elevational view of a preferred embodiment of the invention, positioned for use with a rotary abrasive wheel, and with a new chuck installed.
Figure 5B:
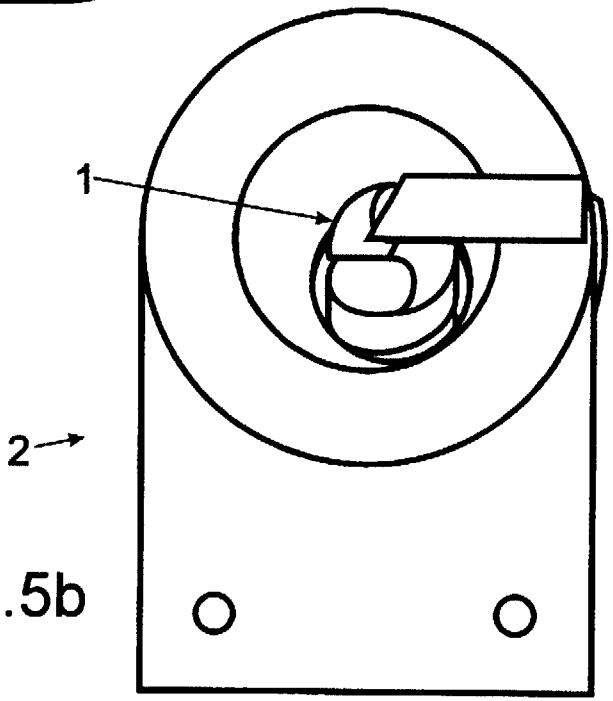
FIG. 5*b* is a rear elevational view of a preferred embodiment of the invention, showing the relative position of a properly aligned drill bit.

The drill bit1 is then removed from notches 15 and 16, and then placed loosely in chuck29, and chuck29 is placed on flange11, with pins13 in holes31 (as shown if FIG. 5*a*). The drill bit1 is then positioned with a cutting lipDE aligned with pointer19 (as shown in FIG. 5*b*), and chuck29 is then tightened. The motor42 is then energized to rotate grinding wheel41. Ring7 is then rotated by hand, to move an end faceA of drill bit1 into contact with abrasive wheel41. The chuck29 is then removed from pins13, rotated 180 degrees, and reinstalled on pins13. Ring7 is then rotated in the same fashion to grind the second end faceA.

Figure 8B:
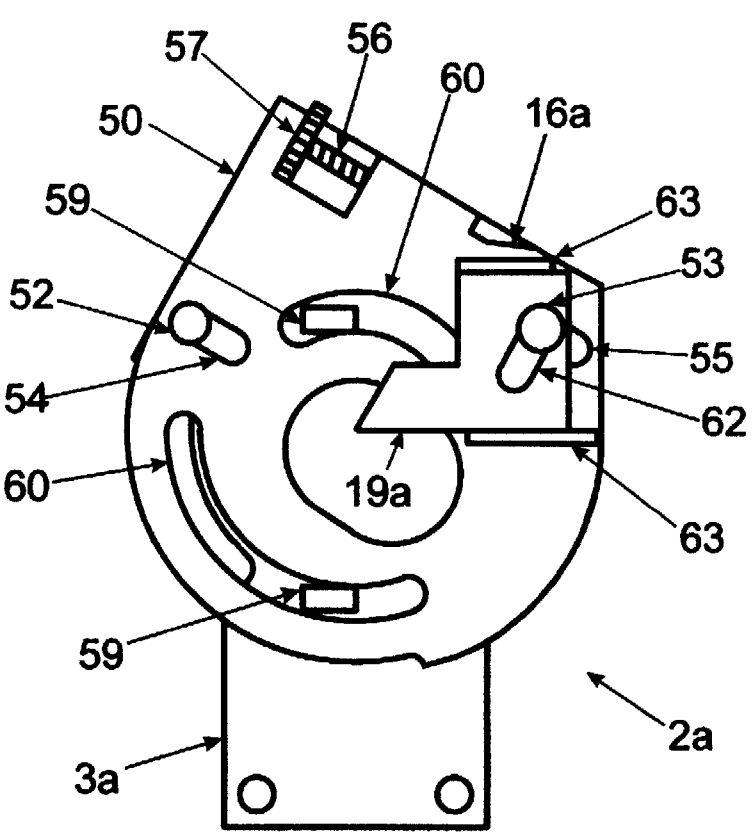
FIG. 8*a* and 8*b* are front and rear elevational views, respectively, of a partial assembly of a second embodiment of the invention.
Figure 8A:
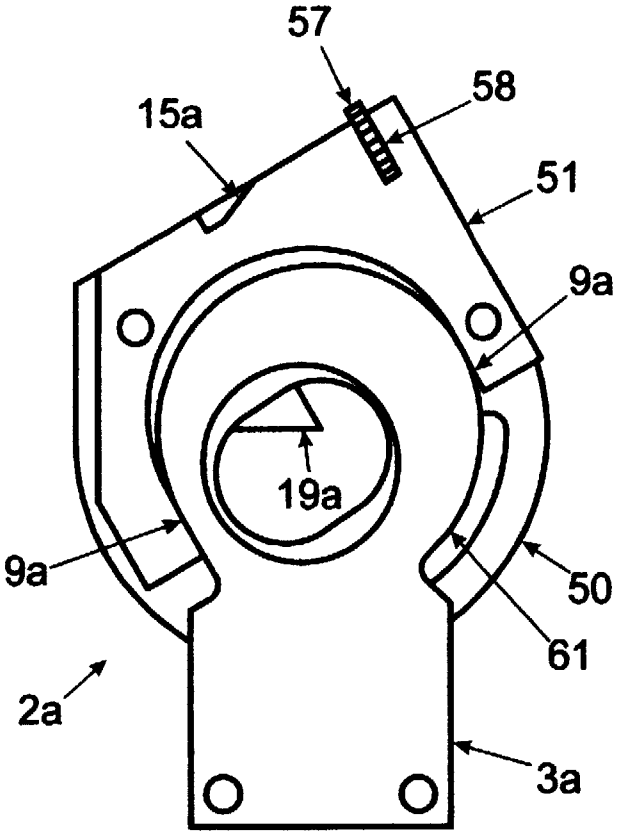

FIG. 8*a* and 8*b* show front and rear views, respectively, of a partial assembly of a second embodiment of the invention, designated as hyperbolic assembly2*a*. A support member (designated as support plate3*a*) has a bearing means (designated as ring61) on its upper portion, and flat parallel guide ways (designated as flat pins59) on its rear face. A rotatable member (designated as rotating plate50) resides rotatably and slidably on the rear face of support plate3*a*, with the inner diameters of circular slots60 resting between flat pins59. A slidable member (designated as spacer plate51) is slidably seated of the front of rotating plate50, by use of shoulder screws52 and 53, in slots54 and 55. Threaded rod56, with thumbwheel57 mounted thereon, is attached to rotating plate50. Thumbwheel57 extends through slot58 in spacer plate51. When thumbwheel57 is adjusted on threaded rod56, slot58 and spacer plate51 are moved in relation to rotating plate50, guided by pins52 and 53 in slots54 and 55. Spacer plate51 has flat parallel guide ways (designated as flat edges9*a*), which reside rotatably and slidably on ring61. Slots 54 and 55 are aligned generally perpendicular to the flat edges9*a* of spacer plate51. As spacer plate51 is offset from rotating plate50, rotating plate50 is moved leftward (as viewed in FIG. 8*b*) on flat pins59. Spacer plate51 rotates about the axis21*a* of ring61 (shown in FIG. 9*b*), which is perpendicular to support plate3*a*. Rotating plate50 rotates about an axis which is perpendicular to support plate3*a*, and which passes through the center point of the arcs formed by circular slots60.

Figure 10:
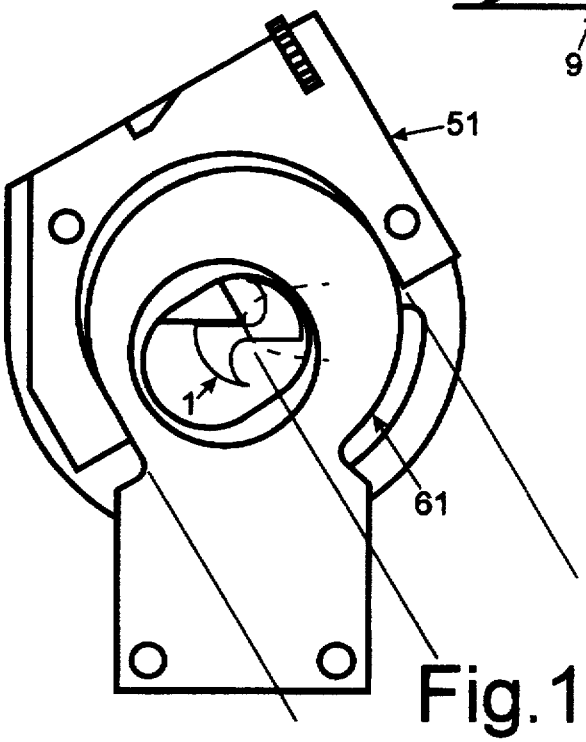
FIG. 10 is a diagram showing drill bit alignment and relative movement in a second embodiment of the invention.
Figure 9A:
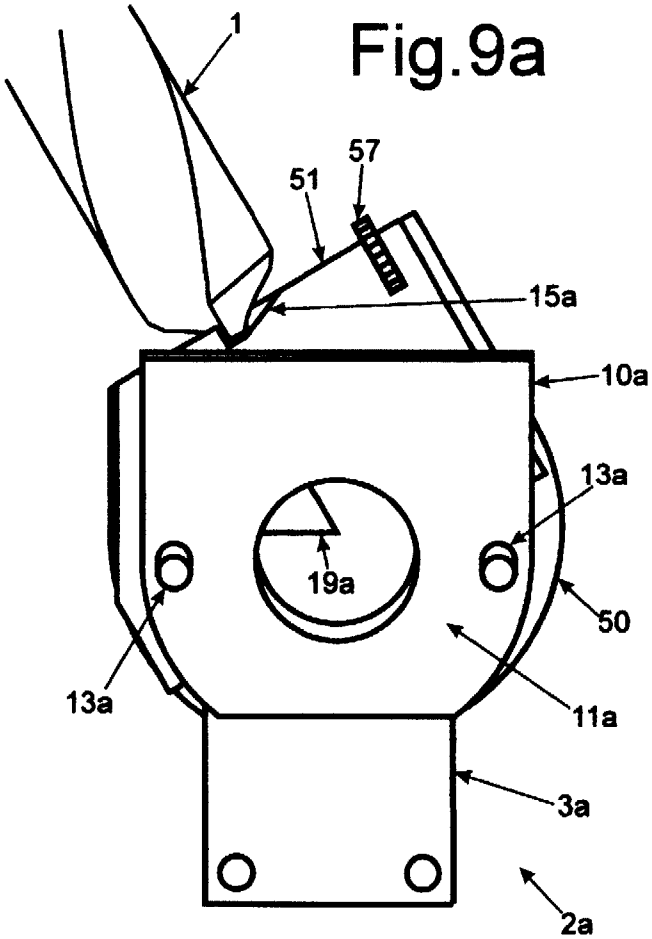
FIG. 9*a* is a front elevational view, of a second embodiment of the invention.

Rotating plate50 and spacer plate51 are caused to rotate together during drill bit sharpening (described later). Rotating plate50 is turned counterclockwise, as viewed in FIG. 5*b*, rotating between flat pins59. Because the axis of rotation of rotating plate50 is offset from the spacer plate51 axis of rotation21*a*, the rotating plate50 is forced rightwardly on pins59, by the action of flat edges9*a* on ring61. As the rotation of rotating plate50 and spacer plate51 continues, the flat edges9*a* reach a generally vertical position, and the rightwardly motion of rotating plate50 ceases. As the rotation continues, rotating plate50 is forced back leftwardly on pins59. The rotating plate50 thus moves in an oscillating horizontal motion which is synchronized with rotation. The result is that spacer plate51 moves in a hyperbolic motion. A point equidistant between flat pins9*a* follows a hyperbolic path (shown in FIG. 10) which has an axis parallel to flat pins59, and a vertex at the axis21*a* of ring61. Front plate10*a*, with a seating means (designated as flange11*a*) for a drill bit holding assembly, is attached to the front of spacer plate51, as in FIG. 9*a* and 9*b*. When drill bit1 is properly installed in chuck29, with chuck29 on pins13*a* of flange11*a*, chisel edgeEG is aligned equidistant from and parallel to the flat edges9*a* of spacer plate51, as in FIG. 10.

The hyperbolic motion is adjustable. When the axis of rotation of rotating plate50 is offset from the axis21*a*, the same amount as radial offsetBJ, then both ends of chisel edgeEG lie on the hyperbolic path. As the spacer plate51 is rotated, with the chisel edgeEG of drill bit1 following the hyperbolic motion, the chisel edgeEG passes through the axis21*a* of ring61. The result is that during the grinding process, a straight chisel edge is duplicated on drill bit1. The synchronized horizontal movement of the rotational axis of the rotating plate50 during grinding reproduces the proper warped-cone shape on drill bit1.

Hyperbolic assembly2*a* has a movable pointer to provide for correct alignment of drill bit1. See FIG. 8*b* and 9*a*. A modified pointer19*a* with slot62 is slidably installed between rails63 on the rear face of rotating plate50. Shoulder screw53, with two shoulders, passes through slot62 and slot55, and is attached to spacer plate51. When thumbwheel57 is turned for the offset adjustment, pin53 moves in slot55, and pin53 in slot62 moves pointer19*a* on rails63. Since slot62 and rails63 are aligned in different directions from slot55, pointer19*a* moves at a different rate, and in a different direction, as spacer plate51. Slot62 and rails63 are arranged such that the end of pointer19*a* is kept aligned with the axis21*a* of ring61 during all offset adjustments. Pointer19*a* may be rotated out of the way during grinding by first pulling it away from rails63, against spring64.

Figure 9B:
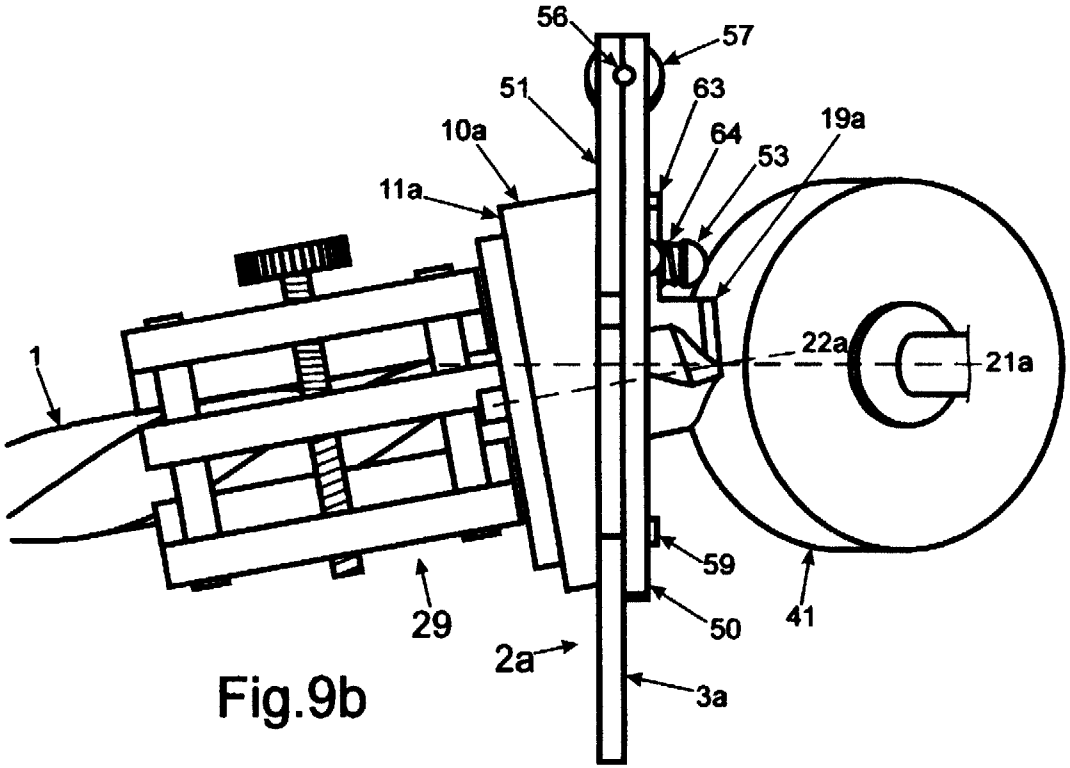
FIG. 9*b* is a side elevational view of a second embodiment of the invention, positioned for use with a rotary abrasive wheel, and with a new chuck installed.

In use, hyperbolic assembly2*a* is installed and aligned with an abrasive wheel41, as in FIG. 9*b*. Hyperbolic assembly2*a* must be used adjacent to the curved radial surface of wheel41. A drill bit1 to be sharpened is then placed with its cutting end between cutout 15*a* on spacer plate51 and cutout16*a* on rotating plate50, as in FIG. 9*a*. The drill bit1 is then aligned and thumbwheel57 is adjusted to bring the lips of drill bit1 into contact with the edges of cutouts15*a* and 16*a*, in the same manner as in FIG. 7. The drill bit1 is then removed from cutouts15*a* and 16*a*, and placed loosely in chuck29. Chuck29 is then placed on pins13*a* (as in FIG. 9*b*). Drill bit1 is aligned with a cutting lip adjacent to pointer19*a*, and chuck29 is then tightened. Drill bit1 is then sharpened, by rotating spacer plate51 and rotating plate50 by hand, to move an end faceA into contact with abrasive wheel41. Chuck29 is then removed from pins13*a*, rotated 180 degrees, and then reinstalled on pins13*a*. The spacer plate51 and rotating plate50 are again rotated in the same fashion to grind the second end faceA.

It is to be recognized that an apparatus to produce such simple motions and adjustments just described can be constructed in a variety of ways. The mechanisms described herein can be easily modified for automation, or to provide adjustments for different drill bit angles, or for producing different shapes such as point splitting or web thinning. Uses of the invention with existing tools are numerous and obvious to persons familiar with such tools. The descriptions herein resemble the working models, but are in no way intended to limit the scope of the invention.

I claim:

1. A method of sharpening drill bits of the type having a point angle, a cutting lip, a lip relief angle, a web thickness, and a longitudinal axis, comprising the steps of aligning the cutting lip of a drill bit in contact with an exterior surface of a rotary abrasive wheel, with said cutting lip in a plane which is normal to said exterior surface, with the longitudinal axis of said drill bit angled from said exterior surface by an amount substantially one-half of the point angle of said drill bit, in a direction parallel with said plane, with the longitudinal axis of said drill bit being angled from said plane by an amount equal to the lip relief angle of said drill bit, in a direction substantially perpendicular to said plane, and by rotating said drill bit about a rotational axis which is in said plane and which is angled from said exterior surface by an amount substantially one-half of the point angle of said drill bit, with the longitudinal axis of said drill bit radially offset from said rotational axis by an amount determined by the web thickness of said drill bit.

2. A method of sharpening drill bits as defined in claim 1 further comprising the step of synchronizing a perpendicular movement of said rotational axis in said plane.

3. An drill bit sharpening apparatus for holding and manipulating a drill bit to be sharpened, said drill bit of the type having a point, a point angle, a lip relief angle, and a web thickness, said drill bit sharpening apparatus comprising:

a support member having a bearing means;

a rotatable member received by said bearing means and having a rotational axis concentric with said bearing means axis, with said support member being capable of holding said rotatable member in adjacency to a rotary abrasive wheel having an exterior surface, the rotational axis of said rotatable member being in a plane which is normal to the exterior surface of said wheel and further being angled from the exterior surface of said wheel by an amount equal to one-half of the point angle of said drill bit;

said rotatable member further having a rotatable member seating means for seating a slidable member, said slidable member being adjustably slidable on the rotatable member seating means in a direction transverse to the rotational axis of said rotatable member, said slidable member further having a slidable member seating means for seating a drill bit holding member, said slidable member seating means being capable of holding said drill bit holding member angled from the rotational axis of said rotatable member by an amount equal to the lip relief angle of said drill bit; and said slidable member further having means to utilize the point of a drill bit as a gauging means, for using the web thickness of said drill bit to determine a position of said slidable member on the rotatable member seat on said rotatable member, prior to sharpening said drill bit.

4. A drill bit sharpening apparatus as defined in claim 3 further comprising a pointer attached to said rotatable member.

5. A drill bit sharpening apparatus for holding and manipulating drill bits for sharpening, said drill bits of the type having a point, a point angle, a lip relief angle, and a web thickness, said drill bit sharpening apparatus comprising:

a support member having a support member bearing means and flat parallel guide ways adjacent to said support member bearing means, the guide ways of said support member being in a direction transverse to an axis of said support member bearing means;

a rotatable member having a rotatable member bearing means rotatably and slidably received by the guide ways of said support member;

said rotatable member further having a rotational axis parallel to the axis of the support member bearing means with said support member being capable of holding said rotatable member in adjacency to a curved exterior radial surface of a rotary abrasive wheel and the rotational axis of said rotatable member being in a plane with an axis of said wheel with the guide ways of said support member being parallel to said plane and the rotational axis of said rotatable member being angled from the surface of said wheel by an amount substantially one-half of the point angle of said drill bit;

said rotatable member further having a rotatable member seating means for seating a slidable member, said slidable member adjustably slidable on the rotatable member seating means in a direction transverse to an axis of rotation of said rotatable member;

said slidable member further having a slidable member seating means for seating a drill bit holding member, the slidable member seating means being capable of holding said drill bit holding member angled from the rotational axis of said rotatable member by an amount substantially equal to the lip relief angle of said drill bit;

said slidable member further having flat parallel guide ways transverse to both the rotational axis of said rotatable member and to a direction of a sliding motion of the slidable member seating means, the guide ways of said slidable member being rotatably and slidably received by the support member bearing means; and said slidable member further having means to utilize the point of said drill bit as a gauging means for using the web thickness of said drill bit to determine a position of said slidable member on the rotatable member seating means, prior to sharpening said drill bit.

6. A drill bit sharpening apparatus as defined in claim 5 further comprising a pointer slidably attached to a rear portion of said rotatable member.

7. A drill bit sharpening apparatus as defined in claim 3 or claim 5 wherein said drill bit holding member comprises a support frame with a seating means for two gripping members, with two gripping members residing slidably on the seating means of said support frame, with one of the two said gripping members having a jaw with a v-shaped groove, with a second of the two said gripping members having a wedge-shaped jaw sized and aligned to cooperate with said groove, with an externally threaded rod attached rotatably to said support frame, with said gripping members having threaded holes to cooperate with different portions of said threaded rod, with said threaded holes having threads differing in pitch and direction, with flat surfaces adjacent to a root of said groove being angled from each other by an amount equal to twice the inverse sine of the ratio of the thread pitch in said hole in said wedge-shaped member to the thread pitch in said hole in said grooved member, and with said support frame and said threaded rod aligning said jaws to hold a drill bit concentrically in said support frame.

8. A drill bit holding means comprising a support frame with a seating means for two gripping members, with the two gripping members residing slidably on the seating means of said support frame, with one of the two said gripping members having a jaw with a v-shaped groove, with a second of the two said gripping members having a wedge-shaped jaw sized and aligned to cooperate with said groove, with an externally threaded rod attached rotatably to said support frame, with said gripping members having threaded holes to cooperate with different portions of said threaded rod, with said threaded holes having threads differing in pitch and direction, with flat surfaces adjacent to a root of said groove being angled from each other by an amount equal to twice the inverse sine of the ratio of the thread pitch in said hole in said wedge-shaped member to the thread pitch in said hole in said grooved member, with said support frame and said threaded rod aligning said jaws to hold a drill bit concentrically in said support frame.

* * * * *